US006423369B1

(12) United States Patent
Yoshimura et al.

(10) Patent No.: US 6,423,369 B1
(45) **Date of Patent: *Jul. 23, 2002**

(54) PROCESS FOR SEALING PORES IN MOLDED PRODUCT, AND BONDED MAGNET WITH PORES SEALED BY THE PROCESS

(75) Inventors: Kohshi Yoshimura, Hyogo; Takeshi Nishiuchi; Fumiaki Kikui, both of Osaka; Masahiro Asano; Takahiro Isozaki, both of Kyoto, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/557,085

(22) Filed: Apr. 21, 2000

(30) Foreign Application Priority Data

Apr. 26, 1999 (JP) ..... 11-117618
Mar. 14, 2000 (JP) ..... 2000-069816

(51) Int. Cl.[7] ..... B05D 1/00; H01F 1/08
(52) U.S. Cl. ..... 427/127; 427/242; 428/551; 428/900
(58) Field of Search ..... 427/11, 127, 181, 427/183, 231, 242; 428/551, 900; 118/417, 418; 264/611, DIG. 58

(56) References Cited

U.S. PATENT DOCUMENTS 2,640,001 A 5/1953 Clayton
2,723,204 A * 11/1955 Pottberg et al.
4,006,660 A * 2/1977 Yamamoto et al.
4,454,175 A * 6/1984 Martin

FOREIGN PATENT DOCUMENTS

AU 164733 * 10/1951
EP 1 028 437 8/2000
JP 5-138525 6/1993
JP 9-205013 * 8/1997

OTHER PUBLICATIONS

Takashi, Corrosion–Resistant Rare Earth Magnet and its Manufacture, Patent Abstracts of Japan, vol. 1996, No. 3, Mar. 29, 1996, Abstract of JP 07302705, published Nov. 14, 1995.

* cited by examiner

*Primary Examiner*—Fred J. Parker
(74) *Attorney, Agent, or Firm*—Armstrong, Westerman & Hattori, LLP

(57) ABSTRACT

A molded product having pores in its surface, an inorganic powder, a fat and oil and media are placed into a treating vessel, and a kinetic energy is supplied to the contents of the treating vessel, thereby forcing the inorganic powder into the pores and hardening it in the pores. In another process, a molded product having pores in its surface and an inorganic powder producing material are placed into a treating vessel, and a kinetic energy is supplied to the contents of the treating vessel, thereby forcing an inorganic powder produced from the inorganic powder producing material into the pores and hardening it in the pores. The inorganic powder producing material performs a role of producing an inorganic powder by the collision of pieces of the inorganic powder producing material against one another, against the molded product and against the inner wall of the vessel, and a role as media for forcing the produced inorganic powder into the pores. Thus, a pore sealing effect can be achieved by cooperation of these roles. Therefore, the process according to the present invention can be carried out selectively and simply in a dry manner for the pores in the molded product to exhibit a pore sealing effect. Then, a corrosion-resistant film such as a plated film having dimensional accuracy can be formed on the surface of the molded product in a subsequent step without exertion of an influence to the surface accuracy of the molded product.

31 Claims, 1 Drawing Sheet

PROCESS FOR SEALING PORES IN MOLDED PRODUCT, AND BONDED MAGNET WITH PORES SEALED BY THE PROCESS

BACKGROUND OF THE INVENTION

1. Field of the Invention

The present invention relates to a process for effectively sealing pores in the surface of a molded product, particularly a bonded magnet, and a bonded magnet having pores sealed by this process.

2. Description of the Related Art

A rare earth metal-based permanent magnet such as an R—Fe—B based permanent magnet wherein R is a rare earth metal, represented by an Nd—Fe—B based permanent magnet, is used at present in a variety of fields, because it is made using a material abundant in natural resources and inexpensive and having a high magnetic characteristic.

In recent years, in electronic and appliance industries where a rare earth metal-based permanent magnet is used, a reduction in size of a part. has been advanced, and in correspondence to this, there is a need for the reduction in size of the magnet itself and for the complication of the shape of the magnet.

From this viewpoint, attention is paid to a bonded magnet easily formed in any shape, and such a bonded magnet has been already put into practical use in various fields.

The rare earth metal-based permanent magnet contains R which is liable to be oxidized in the atmosphere. Therefore, when the magnet is used without being subjected to a surface treatment, the following problem is arisen: The corrosion is advanced from the surface of the magnet by the influence of a small amount of an acid, an alkali or water to generate a rust in the magnet, resulting in the deterioration and dispersion of the magnetic characteristic. Therefore, it is necessary to form a corrosion-resistant film on the surface of the magnet by an electroplating treatment.

However, for example, when an electroplating is applied directly to the bonded magnet having pores in its surface, a surface detergent and/or a plating solution enters into and remains in the pores, thereby bringing about the corrosion of the magnet.

There is a conventionally proposed process which includes an electroplating treatment carried out after a pore sealing step of impregnating the pores in the surface of the magnet with an inorganic material such as glass or a resin in order to overcome the above-described problem (For example, see Japanese Patent Application Laid-open No.7-201620). When the magnet is immersed into an aqueous solution containing an inorganic component and/or a resin component in the pore sealing treatment, there is a possibility that the magnet is corroded by water, and this method is not desirable. Even when the magnet is immersed into a solution made using a resin itself and a non-water solvent, a curing step is necessarily required after the immersing step. Therefore, this process is not desirable from the viewpoint of the simplification of the producing steps. In the above-described process, it is impossible to impregnate only the pores in the surface of the magnet with an inorganic material and/or a resin and hence, a film layer of the inorganic material and/or the resin is formed on the entire surface of the magnet. The film layer is not formed uniformly due to a sagging. Therefore, even if a surface smoothening treatment is carried out at a subsequent step, an adverse influence is exerted to the surface accuracy of the magnet and as a result, it is difficult to form a plated film having an excellent dimensional accuracy. This film layer may be removed, but an increase in number of producing steps is brought about.

Japanese Patent Application Laid-open No.9-205013 describes a process for sealing pores in the surface of a bonded magnet by throwing blast media and a metal powder simultaneously onto the bonded magnet, or placing the blast media, the metal powder and the bonded magnet into a vessel to treat the magnet by rotating or vibrating the entire vessel. However, this process suffers from a problem that even if the metal powder is once formed into the pores in the surface of the magnet, the metal powder formed into the pores are fallen off or removed by the collision against the contents of the vessel and against the inner wall of the vessel and hence, the sealing of the pores is not achieved sufficiently.

Further, for a ring-shaped bonded magnet suitable to be utilized in various small-sized motors such as a spindle motor and a servomotor used in an actuator, it is necessary to sufficiently seal not only pores in the outer surface (including end faces and so on) but also pores in the inner surface.

SUMMARY OF THE INVENTION

Accordingly, it is an object of the present invention to provide a process for sealing pores in the surface of a molded product such as a bonded magnet, which can be carried out selectively and simply in a dry manner for such pores to exhibit an excellent sealing effect, and which cannot exert an influence to the surface accuracy of the molded product.

To achieve the above object, according to a first aspect and feature of the present invention, there is provided a process for sealing pores in a molded product, comprising the steps of placing a molded product having pores in its surface, an inorganic powder, a fat and oil and media into a treating vessel, and supplying a kinetic energy to the contents in the treating vessel, thereby forcing the inorganic powder into the pores and hardening it in the pores.

According to a second aspect and feature of the present invention, in addition to the first feature, the inorganic powder is at least one selected from the group consisting of a metal oxide powder, a metal carbide powder, a metal nitride powder, a metal carbide nitride powder and a metal powder.

According to a third aspect and feature of the present invention, in addition to the second feature, the metal oxide powder is an aluminum oxide powder.

According to a fourth aspect and feature of the present invention, in addition to the second feature, the metal powder is a copper powder.

According to a fifth aspect and feature of the present invention, in addition to the first feature, the media are abrasive stones.

According to a sixth aspect and feature of the present invention, in addition to the fifth feature, the abrasive stone comprises ceramics made by sintering an inorganic powder.

According to a seventh aspect and feature of the present invention, in addition to the first feature, the media are vegetable media.

According to an eighth aspect and feature of the present invention, in addition to the first feature, vegetable media containing a fat and oil are used to place the fat and oil into the treating vessel.

According to a ninth aspect and feature of the present invention, in addition to the first feature, vegetable media having an inorganic powder adhered to its surface by a fat and oil are used to place the inorganic powder and the fat and oil into the treating vessel.

According to a tenth aspect and feature of the present invention, there is provided a process for sealing pores in a molded product, comprising the steps of placing a molded product having pores in its surface and an inorganic powder producing material into a treating vessel, and supplying a kinetic energy to the contents in the treating vessel, thereby forcing an inorganic powder produced from the inorganic powder producing material into the pores and hardening it in the pores.

According to an eleventh aspect and feature of the present invention, in addition to the tenth feature, the inorganic powder producing material is a metal powder producing material for producing a metal powder.

According to a twelfth aspect and feature of the present invention, in addition to the eleventh feature, the metal powder producing material is a copper powder producing material for producing a copper powder.

According to a thirteenth aspect and feature of the present invention, in addition to the eleventh feature, the metal powder producing material is of a needle-like shape and/or a columnar shape having a longer diameter in a range of 0.05 mm to 10 mm.

According to a fourteenth aspect and feature of the present invention, in addition to the tenth feature, the inorganic powder producing material is an abrasive stone comprising ceramics made by sintering an inorganic powder and having a longer diameter in a range of 1 mm to 10 mm.

According to a fifteenth aspect and feature of the present invention, in addition to the tenth feature, a fat and oil is further placed into the treating vessel.

According to a sixteenth aspect and feature of the present invention, in addition to the fifteenth feature, vegetable media containing a fat and oil are used to place the fat and oil into the treating vessel.

According to a seventeenth aspect and feature of the present invention, in addition to the fifteenth feature, an inorganic powder is further placed into the treating vessel.

According to an eighteenth aspect and feature of the present invention, in addition to the seventeenth feature, vegetable media having an inorganic powder adhered to its surface by a fat and oil are used to place the inorganic powder and the fat and oil into the treating vessel.

According to a nineteenth aspect and feature of the present invention, in addition to any of the seventh, eighth, ninth, sixteenth and eighteenth features, the vegetable media are at least one selected from the group consisting of vegetable skin chips, sawdust, chaff, bran, fruit shell and corn cob.

According to a twentieth aspect and feature of the present invention, in addition to the first or tenth feature, the molded product having the pores in its surface is a bonded magnet.

According to a twenty first aspect and feature of the present invention, in addition to the twentieth feature, the bonded magnet is a ring-shaped bonded magnet.

According to a twenty second aspect and feature of the present invention, in addition to the first or tenth feature, the kinetic energy is supplied to the contents of the treating vessel by vibrating and/or agitating the contents of the treating vessel.

According to a twenty third aspect and feature of the present invention, in addition to the twenty second feature, the treating vessel is a treating chamber in a barrel finishing machine.

According to a twenty fourth aspect and feature of the present invention, in addition to the twenty first feature, the ring-shaped bonded magnet is placed into a cylindrical treating vessel, so that the direction of the center axis of the magnet is parallel to the direction of the center axis of the cylindrical treating vessel, and the kinetic energy is supplied to the contents of the cylindrical treating vessel by rotating the cylindrical treating vessel about the center axis thereof.

According to a twenty fifth aspect and feature of the present invention, in addition to the twenty fourth feature, a rod-shaped member is inserted through and disposed in a hole in the ring-shaped bonded magnet, so that it is parallel to the direction of the center axis of the magnet.

According to a twenty sixth aspect and feature of the present invention, there is provided a bonded magnet having pores sealed by a pore sealing process according to the first or tenth feature.

With the process for sealing the pores in the molded product according to the first feature, the inorganic powder is forced into the pores by the action of the media, and the inorganic powder forced into the pores is hardened firmly by the fat and oil. This enables an excellent pore sealing effect to be achieved.

With the process for sealing the pores in the molded product according to the tenth feature, the inorganic powder producing material performs a role of producing an inorganic powder by the collision of pieces of the inorganic powder producing material against one another, against the molded product and against the inner wall of the vessel, and a role as media for forcing the produced inorganic powder into the pores. Thus, an excellent pore sealing effect can be achieved by cooperation of these roles.

The process according to the present invention can be carried out selectively and simply in a dry manner for the pores in the molded product such as the pores in the surface of the bonded magnet to exhibit an excellent pore sealing effect. Then, a corrosion-resistant film such as a plated film having an excellent dimensional accuracy can be formed on the surface of the molded product at a subsequent step without exertion of an influence to the surface accuracy of the molded product.

DETAILED DESCRIPTION OF THE INVENTION

Figure 1:
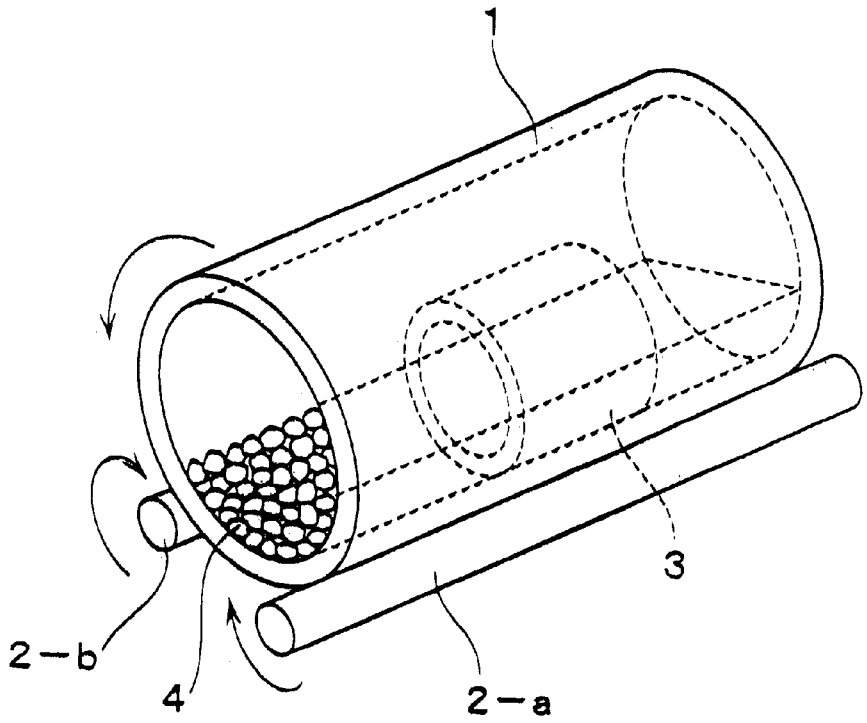
FIG. 1 is a partially perspective view of one example of an apparatus used in a process for sealing pores according to the present invention.

A first process for sealing pores in a molded product according to the present invention will now be described. This process comprises placing a molded product having pores in its surface, an inorganic powder, a fat and oil and media into a treating vessel, and forcing the inorganic powder into the pores to harden the inorganic powder in the pores in the treating vessel by supplying a kinetic energy to the contents of the treating vessel. With this process, the inorganic powder is forced into the pores by the media, and the inorganic powder forced into the pores is hardened firmly by the fat and oil. Thus, an excellent pore sealing effect can be achieved.

Examples of the molded products having pores in its surface, to which the pore sealing process according to the present invention can be applied, are bonded magnets and die-castings. The pore sealing process according to the present invention is suitable for treating pores in the surface of a bonded magnet among others. Therefore, the pore sealing process according to the present invention will be described as being applied to the treatment of pores in the surface of the bonded magnet. When the process is applied to another molded product, proper treating conditions may be set based on the following description.

It should be noted that the bonded magnet may be either a magnetically isotropic bonded magnet or a magnetically anisotropic bonded magnet, if it is made using a magnetic powder and a resinous binder as main components. In addition, the bonded magnet may be a bonded magnet made by bonding a magnetic powder by a metal binder or an inorganic binder in addition to the resinous binder, and in this case, a filler may be contained in the binder.

There are conventionally known rare earth metal-based bonded magnets having various compositions and various crystal structures, and the present invention is intended for all of these bonded magnets.

Examples of such bonded magnets are an anisotropic R—Fe—B based bonded magnet as described in Japanese Patent Application Laid-open No.9-92515, an Nd—Fe—B based nanocomposite magnet having a soft magnetic phase (e.g., an α-Fe phase and an $Fe_3B$ phase) and a hard magnetic phase (e.g., an $Nd_2Fe_{14}B$ phase) as described in Japanese Patent Application Laid-open No.8-203714, and a bonded magnet made using an isotropic Nd—Fe—B based magnetic powder (e.g., a powder made by MQI Co., under a trade name of MQP-B) produced by a melt quenching process used conventionally and widely.

Another example is an R—Fe—N based bonded magnet described in Japanese Patent Publication No.5-82041 and represented by $(Fe_{1-x}R_x)_{1-y}N_y$ wherein $0.07 \leqq x \leqq 0.3$ and $0.001 \leqq y \leqq 0.2$.

The effect of the present invention is not varied depending on the composition and the crystal structure of the magnetic powder forming the bonded magnet and the isotropy and anisotropy of the bonded magnet. Therefore, an intended effect can be obtained in any of the above-described bonded magnets.

The magnetic powder forming the bonded magnet can be produced by a process such as a dissolution and milling process which comprises melting a rare earth metal-based permanent magnet alloy, subjecting it to a casting treatment to produce an ingot, and pulverizing the ingot; a sintered-product pulverizing process which comprises producing a sintered magnet and then pulverizing the sintered magnet; a reduction and diffusion process which produces a magnetic powder directly by the Ca reduction; a rapid solidification process which comprises producing a ribbon foil of a rare earth metal-based permanent magnet alloy by a melting jet caster, and pulverizing and annealing the ribbon foil; an atomizing process which comprises melting a rare earth metal-based permanent magnet alloy, powdering the alloy by atomization and subjecting the powdered alloy to a heat treatment; and a mechanical alloying process which comprises powdering a starting metal, finely pulverizing the powdered metal and subjecting the finely pulverized metal to a heat treatment.

In addition to the above-described process, the magnetic powder forming the R—Fe—N based bonded magnet can be produced by any process such as a gas nitrided process which comprises pulverizing a rare earth metal-based permanent magnet alloy, nitriding the pulverized alloy in an atmosphere of nitrogen gas or ammonia gas, and finely pulverizing the resulting alloy. various processes will be described below with the production of a magnetic powder for an R—Fe—B based bonded magnet being taken as an example.

Dissolution and Milling Process

This is a producing process including the steps of melting a starting material, subjecting the molten material to a casting to produce an ingot and mechanically pulverizing the ingot. For example, a starting material is a powder which comprises ferroboron alloy containing electrolytically produced iron, boron, the balance of Fe and impurities of Al, Si, C or the like, a rare earth metal, or further containing electrolytically produced cobalt. The starting power is subjected to a high frequency dissolution followed by a casting in water-cooled casting copper mold. The resulting ingot is pulverized in a hydrogen occlusion manner, or coarsely pulverized by a usual mechanically pulverizing device such as a stamp mill. Then, the coarsely pulverized material is pulverized finely by a dry pulverizing method using a ball mill or a jet mill, or by a wet pulverizing method using any of various solvents.

With such process, it is possible to produce a fine powder comprising a substantially single crystal or several crystal grains and having an average particle size in a range of 1 μm to 500 μm.

A magnetic powder having a high coercive force can be produced by forming a fine powder having a required composition and an average particle size of 3 μm or less in an oriented manner in the presence of a magnetic field, disintegrating the fine powder, subjecting the disintegrated powder to a heat treatment at a temperature in a range of 800° C. to 1,100° C., and further disintegrating the resulting powder.

Sintered-product Pulverizing Process

This is a process which comprises sintering a required R—Fe—B based alloy and pulverizing the sintered product again to produce a magnetic powder. For example, a starting material is a powder which comprises ferroboron alloy containing electrolytically produced iron, boron, the balance of Fe and impurities of Al, Si, C or the like, a rare earth metal, or further containing electrolytically produced cobalt. The starting powder is alloyed by a high frequency dissolution or the like in an inert gas atmosphere, coarsely pulverized using a stamp mill or the like and further finely pulverized by a ball mill or the like. The produced fine powder is subjected to a pressure molding in the presence or absence of a magnetic field, and the molded product is sintered in vacuum or in an inert gas atmosphere which is a non-oxidizing atmosphere. The sintered product is pulverized again to produce a fine powder having an average particle size in a range of 0.3 μm to 100 μm. Thereafter, the fine powder may be subjected to a heat treatment at a temperature in a range of 500° C. to 1,000° C. in order to increase the coercive force.

Reduction and Diffusion Process

A starting powder comprising at least one metal powder selected from a ferroboron powder, a ferronickel powder, a cobalt powder, an iron powder and a rare earth metal oxide powder, and/or an oxide powder, is selected depending on a composition of a desired starting alloy powder. Metal calcium (Ca) or $CaH_2$ is mixed with the starting powder in an amount 1.1 to 4.0 times (by weight) a stoichiometrically required amount required for the reduction of the rare earth metal oxide. The mixture is heated to a temperature in a range of 900° C. to 1,200° C. in an inert gas atmosphere, and the resulting reaction product is thrown into water, whereby a by-product is removed, thereby providing a powder which has an average particle size in a range of 10 μm to 200 μm and which is not required to be coarsely pulverized. The produced powder may be further pulverized finely by a dry pulverization using a ball mill, a jet mill or the like.

A magnetic powder having a high coercive force can be produced by forming a fine powder having a required composition and an average particle size of 3 μm or less in an oriented manner in the presence of a magnetic field, disintegrating the fine powder, subjecting the disintegrated powder to a heat treatment at a temperature in a range of 800° C. to 1,100° C., and further disintegrating the resulting powder.

Rapid Solidification Process

A required R—Fe—B based alloy is dissolved and subjected to a melt-spin in a jet caster to produce a ribbon foil having a thickness on the order of 20 μm. The ribbon foil is pulverized and subjected to an annealing treatment to provide a powder having fine crystal grains of 0.5 μm or less.

The powder produced from the ribbon foil and having the fine crystal grains is subjected to a hot pressing and a die upsetting treatment to produce a bulk magnet having an anisotropy. The bulk magnet may be pulverized finely.

Atomizing Process

This is a process which comprises dissolving a required R—Fe—B based alloy, dropping the molten alloy from a fine nozzle, atomizing the molten alloy at a high speed by an inert gas or a liquid, subjecting the atomized alloy to a sieving or a pulverization, and then subjecting the resulting material to a drying treatment or an annealing treatment to produce a magnetic powder.

The powder having fine crystal grains is subjected to a hot pressing and a die upsetting treatment to produce a bulk magnet having an anisotropy. The bulk magnet may be pulverized finely.

Mechanical Alloying Process

This is a process which comprises mixing and converting a required starting powder to an amorphous structure at an atom level in an inert gas atmosphere by a ball mill, a vibrating mill, a dry attriter or the like, and subjecting the resulting powder to an annealing treatment to produce a magnetic powder.

The powder having fine crystal grains is subjected to a hot pressing and a die upsetting treatment to produce a bulk magnet having an anisotropy. The bulk magnet may be pulverized finely.

Examples of processes which are capable of providing a magnetic anisotropy to the bulk magnet or the magnetic powder and which may be used, are a hot pressing and pulverizing process (see Japanese Patent Publication No.4-20242) which comprises sintering an alloy powder produced by a rapid solidification process at a low temperature by a hot press or the like, and pulverizing the bulk magnet having a magnetic anisotropy provided by a die upsetting treatment; a pack rolling process (see Japanese Patent No.2596835) which comprises filling an alloy powder produced by a rapid solidification process, as it is, into a vessel made of a metal to provide a magnetic anisotropy to the alloy powder by a plastic working such as a hot rolling; an ingot hot pressing and pulverizing process (Japanese Patent Publication No.7-66892) which comprises subjecting an alloy ingot to a hot plastic working and then pulverizing the resulting ingot to produce a magnetic powder having a magnetic anisotropy; and an HDDR process (see Japanese Patent Publication No. 6-82755) which comprises heating a rare earth metal-based permanent magnet alloy in a hydrogen atmosphere to occlude hydrogen, subjecting the magnetic alloy to a dehydrogenating treatment and cooling the resulting alloy, thereby producing a magnetic powder.

The process for providing the magnetic anisotropy is not limited to those using the combinations of the starting alloys and the anisotropy providing means, and various proper combinations can be used.

Examples of the compositions of the magnetic powders produced by the above-described processes are a composition comprising 8% by atom to 30% by atom of R (R is at least one of rare earth elements including Y, desirably, of light rare earth elements such as Nd, Pr as a main component and the like, or a mixture of at least one of rare earth elements with Nd, Pr or the like), 2% by atom to 28% by atom of B (a portion of B may be substituted by C), and 65% by atom to 84% by atom of Fe (a portion of Fe may be substituted by at least one of Co in an amount of 50% or less of Fe and Ni in an amount of 8% or less of Fe).

To increase the coercive force and the corrosion resistance of the bonded magnet, at least one of the following elements may be incorporated into the starting powder: 3.5% by atom or less of Cu, 2.5% by atom or less of S, 4.5% by atom or less of Ti, 15% by atom or less of Si, 9.5% by atom or less of V, 12.5% by atom or less of Nb, 10.5% by atom or less of Ta, 8.5% by atom or less of Cr, 9.5% by atom or less of Mo, 9.5% by atom or less of W, 3.5% by atom or less of Mn, 9.5% by atom or less of Al, 2.5% by atom or less of Sb, 7% by atom or less of Ge, 3.5% by atom or less of Sn, 5.5% by atom or less of Zr, 5.5% by atom or less of Hf, 8.5% by atom or less of Ca, 8.5% by atom or less of Mg, 7% by atom or less of Sr, 7% by atom or less of Ba, 7% by atom or less of Be and 10% by atom or less of Ga.

For the magnetic powder for an Nd—Fe—B based nanocomposite magnet, it is desirable to select a composition in a range comprising 1% by atom to 10% by atom of R, 5% by atom to 28% by atom of B and the balance comprising substantially Fe.

When a resinous binder is used as a binder for producing a bonded magnet, a resin suitable for each of the molding processes may be used. For example, examples of the resins suitable for a compression molding process are an epoxy resin, a phenol resin, diallyl phthalate and the like. Examples of the resins suitable for an injection molding process are 6-nylon, 12-nylon, polyphenylene sulfide, polybutylene phthalate and the like. Examples of the resins suitable for an extrusion process and a rolling process are polyvinyl chloride, an acrylonitrile-butadiene rubber, chlorinated polyethylene, natural rubbers, Hypalon and the like.

Various processes for producing a bonded magnet are known, and examples of the processes commonly used are an injection molding process, an extruding process, a rolling process and the like in addition to a compression molding process which comprises mixing a magnetic powder, a resinous binder and as required, a silane-based or titanium-based coupling agent, a lubricant for facilitating the molding, and a binding agent for a resin and an inorganic filler in required amounts to knead the mixture, subjecting the mixture to a compression molding, and heating the resulting material to cure the resin.

Examples of the inorganic powders which may be used in the present invention are a powder of metal oxide such as aluminum oxide, zirconium oxide and magnesium oxide, a powder of metal carbide such as silicon carbide, a powder of metal nitride such as aluminum nitride, a powder of metal carbide nitride such as aluminum titanium carbide nitride, aluminum carbide nitride and silicon carbide nitride, a powder of metal such as Cu, Fe, Ni, Co, Cr, Sn, Zn, Pb, Cd, In, Au, Ag and Al, and an alloy including any of these metals. Among them, it is preferable to use an aluminum oxide powder or a copper powder from the viewpoints of the cost and the like. It is of course that two or more types of inorganic powders may be used in the form of a mixture.

The inorganic powders having the same particle shape and the same particle size may be used, or the inorganic powders having the different particle shape and the different particle size may be used in the form of a mixture, but it is desirable that the longer diameter of the particles is in a range of 0.01 μm to 60 μm.

Examples of the fat and oil for securing the inorganic powder forced into the pores are animal fat and oil represented by beef fat, lard, beef tallow, mutton tallow, whale oil, fish oil, liver oil, olive oil, linseed oil, tung oil and the like. It is desirable to use the fat and oil containing a halogen component in a content of 2% or less by weight so as to ensure that the magnet cannot be corroded by the fat and oil. In order to prevent the generation of a volatile component based on the fat and oil, it is desirable that the boiling point of the fat and oil is equal to or higher than 170° C. Any of candelila wax, carnauba wax and stearic acid may be incorporated as desired in order to regulate the melting point of the fat and oil used.

Examples of the media which may be used for forcing the inorganic powder into the pores are known media such as hard media, e.g., metal media, ceramic media and the like, and soft media. Among these media, it is desirable that media having an effect of polishing the surface of the magnet are used. This is because the use of such media ensures that the inorganic powder can be forced into the pores and in addition, the surface of the magnet can be smoothened and further, chips resulting from the polishing of the magnet can be forced as a sealing component into the pores.

One example of the media having the magnet surface polishing effect is an abrasive. A more desirable example of the abrasive is an abrasive stone comprising ceramics resulting from the sintering of an inorganic powder. This is because the use of such an abrasive as media provides an advantage that the polishing chips generated from the media serve as a source of supply of an inorganic powder as a sealing component, in addition to the above-described advantages.

Any of vegetable media known as soft media may be used as the media having the magnet surface polishing effect, such as vegetable skin chips, sawdust, chaff, bran, fruit shell, corn cob and the like. Such media can function as media, and function as a source of supply of the fat and oil and a source of supply of the inorganic powder.

The media having the same shape and the same size for forcing the inorganic powder into pores may be used, or the media having different shapes and different sizes may be used in the form a mixture. When the abrasive is used as the media, it is desirable that the larger diameter of the abrasive is in a range of 1 mm to 10 mm. When the vegetable media are used as the media, it is desirable that the larger diameter of the vegetable media is in a range of 0.5 mm to 3 mm.

The inorganic powder and the fat and oil may be placed alone into the treating vessel. However, the fat and oil inherently contained in the vegetable media which may be placed as the media into the treating vessel, may be utilized. The vegetable media may be impregnated with other fat and oil and placed into the treating vessel. Further, the vegetable media inherently containing the fat and oil may be impregnated with other fat and oil and placed into the treating vessel. If the vegetable media are utilized to supply the fat and oil in the above manner, the vegetable media function as the media and also function as a source of supply of the fat and oil.

The surface of such vegetable media has an adhesion provided by the fat and oil. Therefore, the vegetable media having the inorganic powder adhered to the surface thereof utilizing the adhesion function as the media and also function as a source of supply of the inorganic powder and the fat and oil.

If the method which comprises placing the inorganic powder and the fat and oil carried in the vegetable media is employed, the amounts of inorganic powder and fat and oil placed into the treating vessel may be set as amounts carried in the vegetable media. This leads to an advantage that it is possible to supply the inorganic powder and the fat and oil simultaneously and at a desired ratio into the treating vessel and moreover, to place the inorganic powder and the fat and oil, so that they are easily dispersed uniformly in the treating vessel.

The vegetable media impregnated with the fat and oil can be prepared by kneading the vegetable media with 1% to 5% by weight of the fat and oil based on the vegetable media. One example of such the vegetable media is corn cob impregnated with beef tallow.

The vegetable media having an inorganic powder adhered to the surface thereof by the fat and oil can be prepared, for example, by kneading the vegetable media with 15% by weight or less of the inorganic powder and 1% to 5% by weight of the fat and oil, based on the vegetable media. One particular example of such vegetable media is corn cob having an aluminum oxide powder having a larger diameter of 0.01 μm to 60 μm and adhered to the surface thereof by beef tallow.

It is desirable that the total amount of the bonded magnet, the inorganic powder, the fat and oil and the media placed into the treating vessel is in a range of 10% by volume to 90% by volume of the internal volume of the treating vessel. If the total amount is smaller than 10% by volume of the internal volume of the treating vessel, the throughput is too small, which is not preferred in practical use. On the other hand, if the total amount exceeds 90% by volume of the internal volume of the treating vessel, there is a possibility that the uniform mixing and agitation of the contents does not occur efficiently in the treating vessel, and that the inorganic powder is not forced sufficiently into the pores and not hardened firmly by the fat and oil.

The amounts of the inorganic powder, the fat and oil and the media placed into the treating vessel are determined properly depending on the throughput of the bonded magnet and the rate of pores in the surface of the magnet. It is desirable that the ratio of the total amount of the inorganic powder, the fat and oil and the media placed to the amount of the bonded magnet placed is equal to or smaller than 3 in terms of the volume ratio (of magnet/inorganic powder, fat and oil and media). If the volume ratio exceeds 3, a long time is required for the forcing of the inorganic powder into the pores by the media and for the firm hardening of the inorganic powder by the fat and oil, which is not preferred for practical use and in addition, there is a possibility that the collision of the bonded magnets against one another occurs frequently to cause cracks of the magnets and the falling of particles of the magnetic powder from the surface of the magnet.

When the vegetable media functioning as the media and as a source of supply of the fat and oil or as a source of supply of the inorganic powder and the fat and oil are used, for example, in combination with an abrasive, the ratio of the amount of the vegetable media placed to the amount of the abrasive placed is desirable to be in a range of 0.1 to 2 in terms of the volume ratio (of vegetable media/abrasive). If the volume ratio is smaller than 0.1, there is a possibility that the inorganic powder and the fat and oil are not supplied sufficiently from the vegetable media. If the volume ratio exceeds 2, there is a possibility that the inorganic powder is not forced sufficiently into the pores.

When the inorganic powder is placed alone into the treating vessel, it is desirable that the amount of the inorganic powder placed is in a range of 0.01% by volume to 2.0% by volume of the internal volume of the treating vessel. If the amount of the inorganic powder placed is smaller than 0.01% by volume of the internal volume of the treating vessel, this amount is too small, resulting in a possibility that the inorganic powder is not forced sufficiently into the pores. On the other hand, if the amount of inorganic powder placed exceeds 2.0% by volume of the internal volume of the treating vessel, a phenomenon of flying-up of the inorganic powder in the treating vessel is produced, resulting in a possibility that the amount of inorganic powder forced into the pores is not increased, and a possibility that the deterioration of the working environment is brought about.

The treating time also depends on the throughput, and in general, is in a range of about 1 hour to about 10 hours.

The treating vessel which may be used in the present invention is particularly not limited, if it is capable of supplying a kinetic energy to the contents of the treating vessel. However, a treating vessel capable of supplying the kinetic energy to the contents by applying the vibration and/or the agitation to the contents of the treating vessel is desirable from the viewpoint of the treating efficiency. Examples of such treating vessels are treating chambers in a barrel finishing machine, a ball mill apparatus and the like. The bonded magnet, whose strength is not high, may be cracked or broken, if a strong shock is applied to the magnet. Therefore, it is desirable from this viewpoint that the treating chamber in the barrel finishing machine is used. The barrel finishing machine may be of a known type such as a rotated-type, a vibrated-type and a centrifugal-type. In the case of the rotated-type, it is desirable that the rotational speed is in a range of 20 rpm to 200 rpm. In the case of the vibrated-type, it is desirable that the vibration frequency is in a range of 50 Hz to 100 Hz, and the vibration amplitude is in a range of 1 mm to 50 mm. In the case of the centrifugal-type, it is desirable that the rotational speed is in a range of 70 rpm to 200 rpm.

To carry out the process for sealing pores in a ring-shaped bonded magnet, it is desirable that the ring-shaped bonded magnet is placed into a cylindrical treating vessel, so that the direction of the center axis of the magnet is parallel to the direction of the center axis of the cylindrical treating vessel, and the cylindrical treating vessel is rotated about its center axis, thereby supplying a kinetic energy to the contents of the treating vessel. If the process is carried out in the above manner, not only pores in the outer surface but also pores in the inner surface of even a ring-shaped bonded magnet having a large L/D value (wherein L represents a length of the magnet in a direction of the center axis, and D represents an inside diameter of the magnet) can be sealed easily and sufficiently. One example of an apparatus used for this process is shown in a partially perspective view in FIG. 1.

The apparatus shown in FIG. 1 is an apparatus for rotating a cylindrical treating vessel (which will be referred simply to as a vessel hereinafter) 1 about its center axis. In this case, two rollers 2-*a* and 2-*b* are rotated in the same direction using a rotated-type ball mill apparatus or the like which is not shown. The contents of the vessel 1 are a ring-shaped bonded magnet 3, and vegetable media 4 having an inorganic powder adhered to its surface by fat and oil.

The vessel 1 may be made of a metal or a resin, but it is desirable that a vessel 1 made of the same material as the inorganic powder desired to be forced into and hardened in pores in the surface of the ring-shaped bonded magnet is used. Even if a powder is produced from the vessel itself due to the collision of the contents against the inner wall of the vessel 1, it is not an impurity in the relationship to the contents, if the vessel is made of the same material as the inorganic powder.

In the method for placing the ring-shaped bonded magnet 3 into the vessel 1, the magnet 3 is placed into the vessel 1, so that the direction of the center axis of the magnet 3 is parallel to the direction of the center axis of the vessel 1, as shown in FIG. 1. In FIG. 1, only one ring-shaped bonded magnet 3 is shown as been placed in the vessel, but it is of course that two or more bonded magnets maybe placed in a line. If a plurality of magnets are placed in a line, the collision of the magnets against one another can be inhibited by the line-forming effect, thereby preventing the roughening of the magnet surfaces, and an excellent effect can be provided in respect of an efficiency of loading of the magnets in a given space. In addition, a plurality of ring-shaped bonded magnets having different diameters may be placed in piles (i.e., with a smaller magnet being placed into the hole in a larger magnet).

Figure 2:
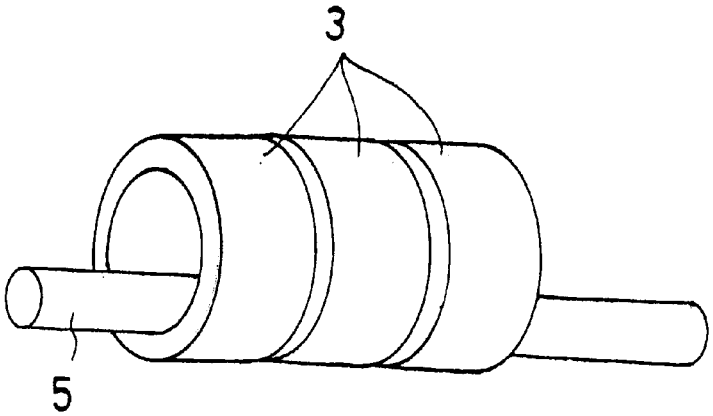
FIG. 2 is a view showing a rod-shaped member disposed in a work such as a ring-shaped bonded magnet.

In placing the ring-shaped bonded magnet 3 into the vessel 1, it is desirable that a rod-shaped member 5 is inserted through and disposed in the hole in the magnet 3, so that it is parallel to the direction of the center axes of the magnet (see FIG. 2). The presence of the rod-shaped member ensures that the behavior of the ring-shaped bonded magnets in the vessel can be settled. Therefore, when a plurality of the magnets are placed, the collision of the magnets against one another can be inhibited, whereby the roughening of the magnet surfaces can be prevented. The rod-shaped member also functions as a medium for forcing the inorganic powder into the pores in the inner surface of the magnets, which is advantageous. The rod-shaped member may be made of a metal or a resin, but it is desirable that the rod-shaped member is made of the same material as the inorganic powder desired to be forced into the pores in the surface of the ring-shaped bonded magnet and hardened in the pores.

When the vessel 1 is rotated about its center axes by the two rollers 2-*a* and 2-*b* (see the arrow in FIG. 1), the vegetable media 4 are allowed to flow in the same direction as the direction of rotation of the vessel relative to the ring-shaped bonded magnets 3. As a result, the inorganic powder adhered to the vegetable media 4 is forced efficiently into the pores in the surface of the magnet and hardened firmly in the pores by the fat and oil. Especially, the vegetable media 4 flowing in the hole in the ring-shaped bonded magnet 3 are brought into flowing contact with the inner surface of the magnet and hence, act advantageously to force the inorganic powder into the pores in the inner surface and harden it in the pores.

The rotational speed of the vessel is desirable to be equal to or higher than 50 rpm. This is because the vegetable media can be brought efficiently and uniformly into flowing contact with the pores in the surface of the ring-shaped bonded magnet. As the rotational speed of the vessel is increased, the vegetable media present in the hole in the ring-shaped bonded magnet are brought more efficiently into flowing contact with the inner surface of the magnet and hence, act advantageously to force the inorganic powder into the pores in the inner surface and harden it in the pores.

However, when the vessel is excessively rotated, there is a possibility that the violent collision of the magnet against the inner surface of the vessel and the contents of the vessel occurs, whereby the particles of the magnetic powder are fallen, and the inorganic powder forced into the pores and hardened in the pores is fallen off or removed. Therefore, it is desirable that the rotational speed of the vessel is equal to or lower than 300 rpm.

A second process for sealing pores in a molded product according to the present invention will be described below. This process comprises placing a molded product having pores in its surface and an inorganic powder producing material into a treating vessel, and forcing an inorganic powder produced from the inorganic powder producing material into the pores to harden the inorganic powder in the pores in the treating vessel by supplying a kinetic energy to the contents of the treating vessel. With this process, the inorganic powder producing material performs a role of producing an inorganic powder by the collision of pieces of the inorganic powder producing material against one another, against the molded product and against the inner wall of the vessel, and a role as media for forcing the produced inorganic powder into the pores. Thus, an excellent pore sealing effect can be achieved by cooperation of these roles.

Examples of the molded product shaving pores in its surface, to which the pore sealing process according to the present invention can be applied, are bonded magnets and die-castings, as in the first process for sealing the pores in the molded product according to the present invention. The pore sealing process according to the present invention will be described as being applied to the treatment of pores in the surface of the bonded magnet. When the process is applied to another molded product, proper treating conditions may be set based on the following description.

Examples of the inorganic powder producing material for producing an inorganic powder are a metal powder producing material for producing a metal powder, particularly a metal powder producing material for producing a powder of a metal selected from the group consisting of Cu, Fe, Ni, Co, Cr, Sn, Zn, Pb, Cd, In, Au, Ag and Al. A metal powder produced from such a metal powder producing material forms a film layer made of the metal powder on the entire surface of the magnet by a mechanochemical reaction which is a specific surface chemical reaction cased by a pure metal surface (i.e., a fresh surface) which is not oxidized after sealing of the pores. This leads to an advantage that the treatment of sealing the pores in the surface of the magnet and the treatment of providing an electric conductivity to the surface of the magnet can be achieved at one time. Particularly, the copper powder is conveniently preferred from the viewpoints of the electric conductivity and the corrosion resistance for a plated film formed by a plating process carried out after the electric conductivity providing treatment and also from the viewpoint of the cost.

The inorganic powder producing material may be a material for producing a metal powder comprising a single metal component as described above, a material for producing a metal powder comprising an alloy containing two or more metal components, a material for producing a metal powder comprising an alloy containing another metal component, or a material for producing a metal powder containing impurities inevitable in the industrial production. It is of course that two or more metal powder producing materials for producing different metal powders may be used in the form of a mixture.

The metal powder producing material, which may be used, may be metal pieces made of only a desired metal, composite metal pieces each comprising a desired metal coated on a core material made of a different metal. The metal pieces may be of any of various shapes such as a needle-like shape (a wire-like shape) a columnar shape, a massive shape, but from the viewpoint of the efficient production of a metal powder, it is desirable to use metal pieces each with a sharp end, for example, a metal piece having a needle-like shape and a metal piece having a columnar shape. Such a desirable shape can be easily provided by employing a known wire-cutting technique.

The size (the longer diameter) of the pieces of the metal powder producing material is desirably in a range of 0.05 mm to 10 mm, more desirably in a range of 0.3 mm to 5 mm, and further desirably in a range of 0.5 mm to 3 mm. This is because the metal powder producing material having such a size can efficiently produce a metal powder having a longer diameter in a range of 0.1 $\mu$m to 10 $\mu$m. A metal powder producing material comprising pieces having the same shape and the same size may be used, or metal powder producing materials comprising pieces having different shapes and different sizes may be used in the form of a mixture.

The metal powder producing material may be an abrasive stone comprising ceramics resulting from the sintering of an inorganic powder and having a longer diameter in a range of 1 mm to 10 mm. This is because such an abrasive functions as a source of supply of an inorganic powder.

The total amount of the bonded magnet and the inorganic powder producing material placed into the treating vessel is desirable to be in a range of 10% by volume to 90% by volume of the internal volume of the treating vessel. If the total amount is smaller than 10% by volume of the internal volume of the treating vessel, the throughput is too small, which is not preferred in practical use. On the other hand, if the total amount exceeds 90% by volume of the internal volume of the treating vessel, there is a possibility that the uniform mixing and agitation of the contents does not occur efficiently in the treating vessel and as a result, a sufficient amount of an inorganic powder is not produced from the inorganic powder producing material, and/or the inorganic powder is not forced sufficiently into the pores and not hardened firmly in the pores.

The ratio of the amount of the inorganic powder producing material placed to the amount of the bonded magnet placed is desirable to be equal to or smaller than 3 in terms of the volume ratio (of magnet/inorganic powder producing material). If the volume ratio exceeds 3, the uniform mixing and agitation of the contents does not occur efficiently in the treating vessel, and a long time is required for producing a sufficient amount of an inorganic powder and forcing the inorganic powder into the pores to harden it in the pores, which is not preferred for practical use. In addition, there is a possibility that the collision of the bonded magnets against one another occurs frequently, thereby causing cracks of the magnets and the falling of particles of the magnetic powder from the surfaces of the magnet.

As described above, in the second process for sealing the pores in the molded product according to the present invention, an excellent sealing effect can be provided, even if no fat and oil is placed into the treating vessel. However, in order to firmly harden the inorganic powder forced in the pores, it is desirable that a fat and oil is placed into the treating vessel. The placing of the fat and oil into the treating vessel may be carried out, for example, using vegetable media impregnate with a fat and oil, as described above. An inorganic powder may be placed along with a fat and oil into the treating vessel, using vegetable media having the inorganic powder adhered to the surfaces thereof by the fat and oil. Such vegetable media are advantageous in that they function as media. The amount of vegetable media placed into the treating vessel is desirable to be that the total amount of the contents including vegetable media in the treating vessel is in a range of 10% by volume to 90% by volume of the internal volume of the treating vessel. The reason is as described above. The ratio of the amount of the vegetable media placed to the amount of the inorganic powder producing material placed is desirable to be in a range of 0.1 to 2 in terms of the volume ratio (of vegetable media/inorganic powder producing material). If the volume ratio is smaller than 0.1, there is a possibility that the inorganic powder and the fat and oil are not supplied in sufficient amounts from the vegetable media. If the volume ratio exceeds 2, there is a possibility that the inorganic powder is not produced in a sufficient amount from the inorganic powder producing material.

The treating vessel and the method for supplying the kinetic energy to the contents, which can be used in the present invention, maybe similar to those described in the first process for sealing the pores in the molded product according to the present invention.

At a subsequent step, a corrosion-resistant film having an excellent dimensional accuracy can be formed on the bonded magnet having the pores in its surface, which have been sealed by the pore sealing process according to the present invention.

The process for forming the corrosion-resistant film is particularly not limited, and a known electroplating process maybe employed. Atypical example of the electroplating process is a plating process using at least one metal selected from the group consisting of Ni, Cu, Sn, Co, Zn, Cr, Ag, Au, Pb and Pt, or an alloy of any of these metals (which may contain any of B, S and P). The thickness of the plated film is equal to or smaller than 50 $\mu$m, desirably, in a range of 10 $\mu$m to 30 $\mu$m.

To carry out an Ni electroplating process, it is desirable that a washing step, an Ni electroplating step, a washing step and a drying step are carried out in the named order. Any of various plating bath tanks can be used depending on the shape of the magnet. In the case of a ring-shaped bonded magnet, it is desirable that a rack plating type or a barrel plating type is used. A known plating bath may be used such as a Watt's bath, a sulfamic acid bath and a Wood's bath. An electrolytic Ni plate is used as an anode, but it is desirable that an S-containing estrand nickel chip is used as the electrolytic Ni plate in order to stabilize the elution of nickel (Ni).

The present invention will now be described in detail by way of particular examples.

EXAMPLES

Example 1

Step A

An epoxy resin was added in an amount of 2% by weight to an alloy powder made by a rapid solidification process and having an average longer particle diameter of 150 $\mu$m and a composition comprising 12% by atom of Nd, 77% by atom of Fe, 6% by atom of B and 5% by atom of Co, and the mixture was kneaded. The resulting material was subjected to a compression molding under a pressure of 686 N/mm$^2$ and then cured at 150° C. for 1 hour, thereby producing a ring-shaped bonded magnet having an outside diameter of 20 mm, an inside diameter of 18 mm and a length of 3 mm. The ring-shaped bonded magnet (blank) had characteristics of Br of 0.67 T, (BH)max of 70.8 KJ/m$^3$, and HcJ of 711 kA/m.

Step B

The 100 ring-shaped bonded magnets produced at the step A (having an apparent volume of 0.3 liters and a weight of 130 g), ceramic media having an apparent volume of 8 liters (which were made by sintering abrasive particles made mainly from aluminum oxide to harden them into granular masses having a longer diameter of 5 mm to 7 mm and which had a true specific gravity of 2.9 to 3.1 g/cm$^3$), and corn cob having an aluminum oxide powder adhered to its surface by beef tallow and having an apparent volume of 8 liters (which was made by kneading 10% by weight of aluminum oxide #800 having a longer diameter equal to or smaller than 20 $\mu$m and 3% by weight of the beef tallow to the corn cob having a longer diameter of 1mm to 2 mm) were placed into a treating chamber in a vibrated-type barrel finishing machine having a volume of 20 liters. The total amount of the magnets, the media and the corn cob was 82% by volume of the internal volume of the treating chamber. Then, the magnets, the media and the corn cob were subjected to a dry treatment for 2 hours under conditions of a vibration frequency of 60 Hz and a vibration amplitude of 20 mm. As a result, ring-shaped bonded magnets each having the aluminum oxide powder forced into and hardened in the pores were produced. It was found from the observation of the magnet surface by an electronic microscope that many of particles of the aluminum oxide powder forced into and hardened in the pores had a longer diameter of about 5$\mu$m.

The ring-shaped bonded magnets having the pores sealed in the above manner were placed into an oil and subjected to an evacuation for 10 minutes in vacuum (equal to or lower than 0.1 Torr). A pore rate was measured from an oil content calculated from a variation in weight of the magnets produced by this operation. As a result, it was found that the pore rate was 0.8% and hence, the pores were sealed extremely effectively (the pore rate of a untreated ring-shaped bonded magnet was 9.8%)

Example 2

Using ring-shaped bonded magnets produced in a process similar to the step A in Example 1, the treatment was carried out in the same manner as in the step B in Example 1, except that the corn cob used at the step B in Example 1 and having the aluminum oxide powder adhered to its surface by the beef tallow was replaced by grinds (in which a fat and oil was inherently contained) of the shell of a walnut, which had a longer diameter of 1 mm and had an aluminum oxide powder adhered to their surfaces by beef tallow. As a result, ring-shaped bonded magnets each having the aluminum oxide powder forced into and hardened in the pores were produced. It was found from the observation of the magnet surface by an electronic microscope that many of particles of the aluminum oxide powder forced into and hardened in the pores had a longer diameter of about 5 $\mu$m. The pore rate of the ring-shaped bonded magnets having the pores sealed in the above manner was equal to that of the ring-shaped bonded magnets subjected to the pore sealing treatment in Example 1.

Example 3

Using ring-shaped bonded magnets produced in a process similar to the step A in Example 1, the treatment was carried out in the same manner as in the step B in Example 1, except that the corn cob used at the step B in Example 1 and having the aluminum oxide powder adhered to its surface by the beef tallow was replaced by grinds (in which a fat and oil was inherently contained) of the shell of a walnut, which had a longer diameter of about 1 mm. As a result, ring-shaped bonded magnets each having an aluminum oxide powder produced from the ceramic media and forced into and hardened in the pores were produced. It was found from the observation of the magnet surface by an electronic microscope that many of particles of the aluminum oxide powder forced into and hardened in the pores had a longer diameter of about 5 μm. The pore rate of the ring-shaped bonded magnets having the pores sealed in the above manner was equal to that of the ring-shaped bonded magnets subjected to the pore sealing treatment in Example 1.

Example 4

Using ring-shaped bonded magnets produced in a process similar to the step A in Example 1, the treatment was carried out in the same manner as in the step B in Example 1, except that the ceramic media hardened into granular masses having a longer diameter in a range of 5 mm to 7 mm and used at the step B in Example 1 were replaced by ceramic media hardened into granular masses having a longer diameter in a range of 3 mm to 4 mm, thereby producing ring-shaped bonded magnets each having the aluminum oxide powder forced into and hardened in the pores. It was found from the observation of the magnet surface by an electronic microscope that many of particles of the aluminum oxide powder forced into and hardened in the pores had a longer diameter of about 5 μm. The pore rate of the ring-shaped bonded magnets having the pores sealed in the above manner was equal to that of the ring-shaped bonded magnets subjected to the pore sealing treatment in Example 1.

Reference Example 1

Step A

The fifty ring-shaped bonded magnets having the pores sealed in Example 1 (having an apparent volume of 0.15 liters and a weight of 65 g) and 10 kg (an apparent volume of 2 liters) of a copper powder producing material of short columnar pieces having a diameter of 1 mm and a length of 1 mm (made by cutting a wire) were placed into a treating chamber in a vibrated-type barrel finishing machine having a volume of 3.5 liters (so that the total amount of them was 61% by volume of the internal volume of the treating chamber), where they were treated in a dry manner for 3 hours under conditions of a vibration frequency of 70 Hz and a vibration amplitude of 3 mm, thereby forming a film layer of a copper powder on the entire surface of each of the magnets.

Step B

The ring-shaped bonded magnets produced at the step A and each having the film layer of the copper powder on the entire surface thereof were washed and then subjected to a rack Ni-electroplating treatment using a plating solution having a composition comprising 240 g/l of nickel sulfate, 45 g/l of nickel chloride, an appropriate amount of nickel carbonate (having a pH value regulated) and 30 g/l of boric acid under conditions of a current density of 2 A/dm$^2$, a plating time of 60 minutes, a pH value of 4.2 and a bath temperature of 55° C. A resulting plated film had a thickness of 22 μm on the side of the outside diameter and a thickness of 20 μm on the side of the inside diameter.

The magnets each having such plated film were subjected to an environment test (a moisture-resistance test) under conditions of a temperature of 80° C., a relative humidity of 90% and a time of 500 hours. After the moisture-resistance test, the observation of the situation of the surface of each magnet (using a microscope having 30 magnifications) and the measurement of the magnetic characteristic deterioration of each magnet were carried out. The dimensional accuracy for the thickness on the side of the inside diameter was also measured (n=50). Results are shown in Tables 1 and 2.

As apparent from Tables 1 and 2, the magnet having the plated film showed an excellent corrosion resistance, and the plated film was formed at a high thickness accuracy.

TABLE 1

| Situation of surface after moisture-resistance test (observed by microscope having 30 magnifications | Thickness accuracy (μm) | Producing method |
|---|---|---|
| Not changed (Not rusted) | 20 ± 1 | Film layer of Cu powder + Ni electroplating treatment |

TABLE 2

| Before moisture-resistance test | | | After moisture-resistance test | | | Deterioration rate (%) in magnetic characteristic | | |
|---|---|---|---|---|---|---|---|---|
| Br (T) | HcJ (kA/m) | (BH) max (kJ/m$^3$) | Br (T) | HcJ (kA/m) | (BH) max (kJ/m$^3$) | Br | HcJ | (BH) max |
| 0.66 | 703 | 71.6 | 0.65 | 687 | 70.0 | 3.0 | 3.4 | 1.1 |

Deterioration rate (%) in magnetic characteristic=((magnetic characteristic of the blank)−(magnetic characteristic after moisture-resistance test))/(magnetic characteristic of the blank)×100

Example 5

Using ring-shaped bonded magnets produced in a process similar to the step A in Example 1, the treatment was carried out in the same manner as at the step B in Example 1, except that corn cob having an aluminum oxide powder adhered to its surface by beef tallow and having an apparent volume of 16 liters was placed into the treating chamber in place of the ceramic media having the apparent volume of 8 liters and the corn cob having the aluminum oxide powder adhered to its surface by the beef tallow and having the apparent volume of 8 liters, thereby producing ring-shaped bonded magnets each having the aluminum oxide powder forced into and hardened in the pores. It was found from the observation of the magnet surface by an electronic microscope that many of particles of the aluminum oxide powder forced into and hardened in the pores had a longer diameter of about 5 μm.

Example 6

Using ring-shaped bonded magnets produced in a process similar to the step A in Example 1, the treatment was carried out in the same manner as at the step B in Example 1, except that a copper powder producing material of short columnar pieces (made by cutting a wire) having a diameter of 0.6 mm and a length of 0.6 mm and having an apparent volume of 8 liters and corn cob impregnated with beef tallow having an apparent volume of 8 liters (made by kneading 1.4% by weight of the beef tallow to the corn cob having a longer diameter of 1 mm to 2 mm) were placed into the treating chamber in place of the ceramic media having the apparent volume of 8 liters and the corn cob having the aluminum oxide powder adhered to its surface by the beef tallow and having the apparent volume of 8 liters. As a result, ring-shaped bonded magnets each of which had a copper powder produced from the copper powder producing material and forced into and hardened in the pores and each of which had a film layer formed of the copper powder on the entire surface thereof, were produced. It was found from the observation of the broken face by an electronic microscope that many of particles of the copper powder forced into and hardened in the pores had a longer diameter on the order of 1 μm to 2 μm.

Example 7

Using ring-shaped bonded magnets produced in a process similar to the step A in Example 1, the treatment was carried out in the same manner as at the step B in Example 1, except that a copper powder producing material of short columnar pieces (made by cutting a wire) having a diameter of 0.6 mm and a length of 0.6 mm and having an apparent volume of 16 liters was placed into the treating chamber in place of the ceramic media having the apparent volume of 8 liters and the corn cob having the aluminum oxide powder adhered to its surface by the beef tallow and having the apparent volume of 8 liters. As a result, ring-shaped bonded magnets each of which had a copper powder produced from the copper powder producing material and forced into and hardened in the pores and each of which had a film layer formed of the copper powder on the entire surface thereof, were produced. It was found from the observation of the broken face by an electronic microscope that many of particles of the copper powder forced into and hardened in the pores had a longer diameter on the order of 1 μm to 2 μm.

Example 8

Using ring-shaped bonded magnets produced in a process similar to the step A in Example 1, the treatment was carried out in the same manner as at the step B in Example 1, except that 200 g (an apparent volume of 0.05 liters) of a commercially available copper powder (comprising a needle-shaped pieces having a longer diameter in a range of 1 μm to 30 μm) and corn cob impregnated with beef tallow having an apparent volume of 16 liters were placed into the treating chamber in place of the ceramic media having the apparent volume of 8 liters and the corn cob having the aluminum oxide powder adhered to its surface by the beef tallow and having the apparent volume of 8 liters, thereby producing ring-shaped bonded magnets each having the copper powder forced into and hardened in the pores. It was found from the observation of the magnet surface by an electronic microscope that many of particles of the copper powder forced into and hardened in the pores had a longer diameter on the order of 1 μm to 10 μm.

Example 9

The 14 ring-shaped bonded magnets (having a weight of 18 g) produced in a process similar to the step A in Example 1 were placed into a cylindrical vessel made of copper and having a volume of 40 ml (having an inside diameter of 32 mm and a length of 50 mm), so that the direction of the center axis of each magnet was parallel to the direction of the center axis of the cylindrical vessel. A pipe made of copper (having a diameter of 8 mm and a length of 45 mm) was inserted through and disposed in the holes of the magnets. Further, ceramic media (which were made by sintering abrasive particles made mainly from aluminum oxide to harden them into granular masses having a longer diameter of 5 mm to 7 mm and which had a true specific gravity of 2.9 to 3.1 g/cm$^3$) and corn cob having an aluminum oxide powder adhered to its surface by beef tallow (made by kneading 10% by weight of aluminum oxide #800 having a longer diameter equal to or smaller than 20 μm and 3% by weight of the beef tallow to the corn cob having a longer diameter of 1 mm to 2 mm) were placed in the form of a blend made at a volume ratio of 1:1 into the vessel, so that the total amount of the ceramic media and the corn cob was equal to 30% by volume of the internal volume of the vessel, and the total amount of the contents including the ring-shaped bonded magnets was equal to 36% by volume of the internal volume of the vessel. The cylindrical vessel was rotated at 150 rpm for 2 hours about the center axis thereof, using a rotated-type ball mill apparatus. As a result, ring-shaped bonded magnets each having the aluminum oxide powder forced into and hardened in the pores were produced. It was found from the observation of the magnet surface by an electronic microscope that many of particles of the aluminum oxide powder forced into and hardened in the pores had a longer diameter of about 5 μm.

Example 10

Using ring-shaped bonded magnets produced in a process similar to the step A in Example 1, the treatment was carried out in the same manner as in Example 9, except that the ceramic media used in Example 9 were replaced a copper powder producing material of short columnar pieces (made by cutting a wire) having a diameter of 0.6 mm and a length of 0.6 mm, thereby producing ring-shaped bonded magnets each having a copper powder produced from the copper powder producing material and the aluminum oxide powder forced into and hardened in the pores. It was found from the observation of the magnet surface by an electronic microscope that many of particles of the copper powder forced into and hardened in the pores had a longer diameter on the order of 1 μm to 2 μm and many of particles of the aluminum oxide powder forced into and hardened in the pores had a longer diameter of about 5 μm.

Example 11

Using ring-shaped bonded magnets produced in a process similar to the step A in Example 1, the treatment was carried out in the same manner as in Example 9, except that in place of the blend made at the volume ratio of 1:1 from the ceramic media and the corn cob having the aluminum oxide powder adhered to the surface thereof by the beef tallow being placed into the vessel in the total amount equal to 30% by volume of the internal volume of the vessel in Example 9, a blend made at a volume ratio of 1:1 from a copper powder producing material of short columnar pieces (made by cutting a wire) having a diameter of 0.6 mm and a length of 0.6 mm and corn cob impregnated with beef tallow (made by kneading 1.4% by weight of the beef tallow to the corn cob having a longer diameter of 1 mm to 2 mm) was placed into the vessel in the total amount equal to 30% by volume of the internal volume of the vessel, and the treating time was equal to 4 hours. This produced ring-shaped bonded magnets each of which had a copper powder produced from the copper powder producing material and forced into and hardened in the pores and each of which had a film layer formed of the copper powder on the entire surface thereof. It was found from the observation of the broken face by an electronic microscope that many of particles of the copper powder forced into and hardened in the pores had a longer diameter on the order of 1 μm to 2 μm.

Example 12

Using ring-shaped bonded magnets produced in a process similar to the step A in Example 1, the treatment was carried out in the same manner as in Example 9, except that in place of the blend made at the volume ratio of 1:1 from the ceramic media and the corn cob having the aluminum oxide powder adhered to the surface thereof by the beef tallow being placed into the vessel in the total amount equal to 30% by volume of the internal volume of the vessel in Example 9, a copper powder producing material of short columnar pieces (made by cutting a wire) having a diameter of 0.6 mm and a length of 0.6 mm was placed into the vessel in an amount of 30% by volume of the internal volume of the vessel, thereby producing ring-shaped bonded magnets each of which had a copper powder produced from the copper powder producing material and forced into and hardened in the pores and each of which had a film layer formed of the copper powder on the entire surface thereof. It was found from the observation of the broken face by an electronic microscope that many of particles of the copper powder forced into and hardened in the pores had a longer diameter on the order of 1 $\mu$m to 2 $\mu$m.

Example 13

Using ring-shaped bonded magnets produced in a process similar to the step A in Example 1, the treatment was carried out in the same manner as in Example 9, except that in place of the blend made at the volume ratio of 1:1 from the ceramic media and the corn cob having the aluminum oxide powder adhered to the surface thereof by the beef tallow being placed into the vessel in the total amount equal to 30% by volume of the internal volume of the vessel in Example 9, corn cob having an aluminum oxide powder adhered to the surface thereof by beef tallow was placed into the vessel in an amount of 30% by volume of the internal volume of the vessel, thereby producing ring-shaped bonded magnets each having the aluminum oxide forced into and hardened in the pores. It was found from the observation of the magnet surface by an electronic microscope that many of particles of the aluminum oxide powder forced into and hardened in the pores had a longer diameter of about 5 $\mu$m.

What is claimed is:

1. A process for sealing pores in a molded product, comprising the steps of placing into a treating vessel a molded product having pores in its surface, an inorganic powder, a member selected from the group consisting of fats and oils, and treating media, the volume ratio of the molded product to the total amount of inorganic powder, member selected from the group consisting of fats and oils, and treating media being at most 3, and supplying kinetic energy in said treating vessel to the molded product, inorganic powder, member selected from the group consisting of fats and oils, and treating media, whereby said inorganic powder is forced into said pores and hardened in said pores.

2. A process for sealing pores in a molded product according to claim 1, wherein said inorganic powder is at least one selected from the group consisting of a metal oxide powder, a metal carbide powder, a metal nitride powder, a metal carbide nitride powder and a metal powder.

3. A process for sealing pores in a molded product according to claim 2, wherein said metal oxide powder is an aluminum oxide powder.

4. A process for sealing pores in a molded product according to claim 2, wherein said metal powder is a copper powder.

5. A process for sealing pores in a molded product according to claim 1, wherein said media are abrasive stones.

6. A process for sealing pores in a molded product according to claim 5, wherein said abrasive stones comprise ceramics made by sintering an inorganic powder.

7. A process for sealing pores in a molded product according to claim 1, wherein said media are vegetable media.

8. A process for sealing pores in a molded product according to claim 1, wherein vegetable media containing a fat and oil are used to place the fat and oil into said treating vessel.

9. A process for sealing pores in a molded product according to claim 1, wherein vegetable media having an inorganic powder adhered to its surface by a fat and oil are used to place the inorganic powder and the fat and oil into said treating vessel.

10. A process for sealing pores in a molded product according to any of claims 7, 8 and 9, wherein said vegetable media are at least one selected from the group consisting of vegetable skin chips, sawdust, chaff, bran, fruit shell and corn cob.

11. A process for sealing pores in a molded product according to claim 1, wherein said molded product having the pores in its surface is a bonded magnet.

12. A process for sealing pores in a molded product according to claim 11, wherein said bonded magnet is a ring-shaped bonded magnet.

13. A process for sealing pores in a molded product according to claim 1, wherein the kinetic energy is supplied to the contents of said treating vessel by vibrating and/or agitating the contents of said treating vessel.

14. A process for sealing pores in a molded product according to claim 13, wherein said treating vessel is a treating chamber in a barrel finishing machine.

15. A process for sealing pores in a molded product according to claim 12, wherein said ring-shaped bonded magnet is placed into a cylindrical treating vessel, so that the direction of the center axis of said magnet is parallel to the direction of the center axis of said cylindrical treating vessel, and the kinetic energy is supplied to the contents of said cylindrical treating vessel by rotating said cylindrical treating vessel about the center axis thereof.

16. A process for sealing pores in a molded product according to claim 15, wherein a rod-shaped member is inserted through and disposed in a hole in said ring-shaped bonded magnet, so that it is parallel to the direction of the center axis of said magnet.

17. A process for sealing pores in a bonded magnet in a dry manner, comprising the steps of placing into a treating vessel a bonded magnet having pores in its surface and an inorganic powder producing material, and supplying kinetic energy in said treating vessel to the bonded magnet and the inorganic powder producing material which produces an inorganic powder having a smaller particle size than the inorganic powder producing material as a result of collision caused by the kinetic energy, wherein said inorganic powder producing material also serves as treating media for forcing the produced inorganic powder into said pores and hardening the inorganic powder in said pores.

18. A process for sealing pores in a bonded magnet according to claim 17, wherein said inorganic powder producing material is a metal powder producing material for producing a metal powder.

19. A process for sealing pores in a bonded magnet according to claim 17, wherein said metal powder producing material is a copper powder producing material for producing a copper powder.

20. A process for sealing pores in a bonded magnet according to claim 17, wherein said metal powder producing material is of a needle shape and/or a columnar shape having a longer diameter in a range of 0.05 mm to 10 mm.

21. A process for sealing pores in a bonded magnet according to claim 17, wherein said inorganic powder producing material is an abrasive stone comprising ceramics made by sintering an inorganic powder and having a longer diameter in a range of 1 mm to 10 mm.

22. A process for sealing pores in a bonded magnet according to claim 17, wherein vegetable media containing a member selected from the group consisting of fats and oils are further placed into said treating vessel, the volume ratio of said vegetable media to the amount of said inorganic powder producing material being in a range of 0.1 to 2.

23. A process for sealing pores in a bonded magnet according to claim 22, wherein a supplemental inorganic powder is further placed into said treating vessel.

24. A process for sealing pores in a bonded magnet according to claim 23, wherein vegetable media containing a member selected from the group consisting of fats and oils and having said supplemental inorganic powder adhered to its surface by said member selected from the group consisting of fats and oils are used to place the supplemental inorganic powder into said treating vessel.

25. A process for sealing pores in a bonded magnet according to any of claims 22 and 24, wherein said vegetable media are at least one selected from the group consisting of vegetable skin chips, sawdust, chaff, bran, fruit shell and corn cob.

26. A process for sealing pores in a bonded magnet according to claim 17, wherein said bonded magnet is a ring-shaped bonded magnet.

27. A process for sealing pores in a bonded magnet according to claim 17, wherein the kinetic energy is supplied to the contents of said treating vessel by vibrating and/or agitating the contents of said treating vessel.

28. A process for sealing pores in a bonded magnet according to claim 27, wherein said treating vessel is a treating chamber in a barrel finishing machine.

29. A process for sealing pores in a bonded magnet according to claim 26, wherein said ring-shaped bonded magnet is placed into a cylindrical treating vessel, so that the direction of the center axis of said magnet is parallel to the direction of the center axis of said cylindrical treating vessel, and the kinetic energy is supplied to the contents of said cylindrical treating vessel by rotating said cylindrical treating vessel about the center axis thereof.

30. A process for sealing pores in a bonded magnet according to claim 29, wherein a rod-shaped member is inserted through and disposed in a hole in said ring-shaped bonded magnet, so that it is parallel to the direction of the center axis of said magnet.

31. A bonded magnet having pores sealed by a pore sealing process according to claim 1 or 17.

* * * * *